US005437449A

United States Patent [19]

Zink

[11] Patent Number: 5,437,449

[45] Date of Patent: Aug. 1, 1995

[54] GOLF CLUB HOLDER AND TURF REPAIR TOOL

[76] Inventor: Albert H. Zink, 12502 Skylark Dr., Sun City West, Ariz. 85375

[21] Appl. No.: 282,889

[22] Filed: Jul. 29, 1994

[51] Int. Cl.[6] ..... A63B 57/00

[52] U.S. Cl. ..... 273/32 B; 248/156; 248/76

[58] Field of Search ..... 273/32 R, 32 B; 248/76, 248/85, 87, 156

[56] References Cited

U.S. PATENT DOCUMENTS

| | | | |
|---|---|---|---|
| 1,178,558 | 4/1916 | Turner | 248/156 X |
| 1,537,237 | 5/1925 | Kaestner | 248/87 |
| 2,204,692 | 6/1940 | Parisio | 248/38 |
| 2,574,441 | 11/1951 | Stewart | 248/87 |
| 2,858,868 | 3/1958 | Wallace | 273/32 B X |
| 2,894,706 | 7/1959 | Cappio | 248/87 |
| 2,921,744 | 1/1960 | Falcetti | 248/87 X |
| 3,219,083 | 11/1965 | Asquith | 273/32 B X |
| 4,176,819 | 12/1979 | Lowe | 248/513 |
| 4,545,579 | 10/1985 | McCain | 273/162 R |
| 4,805,911 | 2/1989 | Fergazzo | 273/162 R |
| 4,832,338 | 5/1989 | Magazzi | 273/32 A |
| 5,076,581 | 12/1991 | Boberg | 273/32 R |
| 5,116,046 | 5/1992 | Pace | 273/32 B |
| 5,127,530 | 7/1992 | Ortuno | 211/70.2 |
| 5,149,087 | 9/1992 | Thompson | 273/32 |
| 5,152,524 | 10/1992 | Brown | 273/32 B |

*Primary Examiner*—George J. Marlo

[57] ABSTRACT

A golf club holder and turf repair tool includes a main body having an upper portion, an intermediate portion extending from the upper portion at substantially a right angle thereto, and a lower portion extending from the intermediate portion at substantially a right angle thereto and arranged generally parallel to the upper portion. A pair of clamps are attached to the main body upper portion for receiving and holding a grip on a golf club. Each clamp has a pair of resilient arms that are deflected when the golf club grip is inserted in the clamp. The main body lower portion includes a pair of prongs which may be used in repairing ball marks and impressions on putting greens. The prongs are arranged side by side below the clamps for penetrating the ground so that the golf club is supported in a generally vertical orientation relative to the ground with the head elevated above the grip.

8 Claims, 1 Drawing Sheet

GOLF CLUB HOLDER AND TURF REPAIR TOOL

BACKGROUND OF THE INVENTION

This invention relates generally to a device comprised of a golf club holder and turf repair tool and, in particular, to a device that holds a golf club in a generally vertical orientation relative to the ground.

While playing golf, there may be occassions when a golfer lays a golf club on the ground, forgets it and leaves it behind, thereby losing the golf club. This frequently happens when a golfer approaches a putting green with two clubs, i.e. one club that may be used for chipping and another club which is usually a putter. After the golfer has chipped his ball onto the putting green, the club used for chipping is laid down on the ground while the golfer uses the putter. Often the golfer forgets the chipping club when he leaves the putting green. Therefore, a need exists for a device which supports a golf club in an orientation where it is easily noticeable to thereby prevent a golfer from leaving the golf club behind.

When a golf club is laid on wet turf, its grip gets wet and thus becomes difficult for the golfer to hold onto. An additional need exists for a device which supports a golf club in an orientation where the grip remains dry. Ball marks and impressions on putting greens often are not adequately repaired because some golfers have difficulty bending over to repair them due to their back ailments. A further need exists for a device which permits a golfer to repair ball marks and impressions on putting greens without bending over.

U.S. Pat. No. 4,832,338 to M. Magazzi discloses a device that serves as a stand for a single golf club. The Magazzi device includes a pair of spikes that may be inserted into the ground, and a C-shaped frame for receiving a golf club shaft. Upper and lower portions of the C-shaped frame are covered with frictional material to prevent the golf club from slipping out of the C-shaped frame. The Magazzi device has a drawback in that it is too bulky and difficult to use.

U.S. Pat. Nos. 2,858,868 to A. C. Wallace and 3,219,083 to B. W. Asquith disclose golf club carriers which also may be used as stands for supporting golf clubs. These carriers are designed to replace conventional golf bags by holding several golf clubs simultaneously. The Wallace carrier includes an elongated shaft with a pointed lower end that may be inserted into the ground, and two rings made of flexible material attached to the shaft for receiving golf clubs. The Asquith carrier has a vertical portion with a spike at its lower end for insertion into the ground, and a pair of club rest members pivotally mounted near an upper end of the vertical portion.

U.S. Pat. Nos. 5,127,530 to J. Ortuno and 5,149,087 to J. W. Thompson disclose golf club support stands that may be carried in a conventional golf bag. The Ortuno stand includes a vertical leg portion with a lower end which may be inserted into the ground, and a receptacle portion located adjacent an upper end of the leg portion. In use, a golfer may rest several golf clubs against the receptacle portion of the Ortuno stand. The Thompson stand includes an elongated rod with a handle at its upper end and a divot repair tool at its lower end, and a hook pivotally mounted on the rod for receiving one or more golf clubs.

U.S. Pat. Nos. 4,545,579 to I. I. McCain and 4,805,911 to A. P. Ferlazzo et al disclose support stands that are attached to golf clubs. The McCain stand includes a semicylindrical sleeve which receives a golf club shaft, and a support leg pivotally connected to the sleeve. The Ferlazzo et al stand includes a support leg pivotally connected to a section mounted inside a golf club grip.

U.S. Pat. Nos. 5,076,581 to W. J. Boberg, 5,116,046 to L. A. Pace and 5,152,524 to S. M. Brown disclose props for holding golf clubs so that their grips are off the ground to keep the grips dry and clean. The Boberg and Pace props are one-piece accessories with a slot or an opening for receiving a golf club shaft. The Brown prop has a T-shaped body with a horizontal arm on which a golf club may rest.

SUMMARY OF THE INVENTION

It is an object of the present invention to provide a device for supporting a golf club in an orientation where it is easily noticeable thus preventing loss of the golf club.

Another object of the present invention to provide a device for supporting a golf club in an orientation where its grip remains dry.

A further object of the present invention is to provide a device which permits a golfer to repair ball marks and impressions on putting greens without bending over thereby maintaining putting greens in good condition.

The present invention provides a device for holding a golf club in a generally vertical orientation relative to the ground, wherein the golf club has a head for impacting with a golf ball, an elongated shaft connected at one end to the head, and a grip attached to the other end of the elongated shaft. The device comprises a main body having an upper portion, an intermediate portion extending from the upper portion at substantially a right angle thereto, and a lower portion extending from the intermediate portion at substantially a right angle thereto and arranged generally parallel to the upper portion. Clamping means are attached to the main body upper portion for receiving and holding the grip on the golf club. The main body lower portion includes prong means for penetrating the ground so that the golf club is supported in the generally vertical orientation with the head elevated above the grip.

In the preferred embodiment of the device, the clamping means comprises a pair of clamps spaced apart along a length dimension of the main body upper portion. Each of the clamps has a pair of resilient arms which are deflected outwardly away from each other when the golf club grip is inserted in the clamps. The prong means comprises a pair of prongs arranged side by side below the clamps. When the device is viewed in side elevation, the prongs are disposed in a plane that is generally parallel to a longitudinal axis of the golf club.

DESCRIPTION OF THE PREFERRED EMBODIMENT

Figure 2:
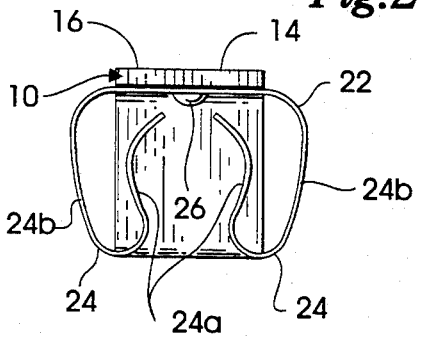
FIG. 2 is a top plan view of the device shown in FIG. 1.

Referring to FIGS. 1–4, a device comprised of a golf club holder and turf repair tool is generally designated 10 and is shown holding a golf club 12. The device 10 includes a main body 14 which has an upper portion 16, an intermediate portion 18 and a lower portion 20. The intermediate portion 18 extends from the upper portion 16 at substantially a right angle thereto, and the lower portion 20 extends from the intermediate portion 18 at substantially a right angle thereto. The lower portion 20 is arranged so that it is generally parallel to the upper portion 16.

In the preferred embodiment of the device 10, the main body 14 may be made of a suitable metal such as steel or aluminum formed by a stamping process. The main body 14 has a width dimension of approximately 1.00 inch. The upper portion 16 has a length dimension of approximately 4.50 inches, the intermediate portion 18 has a length dimension of approximately 1.25 inches, and the lower portion 20 has a length dimension of approximately 2.50 inches.

A pair of clamps 22 are mounted on the upper portion 16 of the main body 14 for receiving and holding a grip 13 on the golf club 12. Each clamp 22 has a pair of resilient arms 24 which are deflected outwardly away from each other when the grip 13 is inserted in the clamps 22. The resilient arms 24 have inner portions **24*a* and outer portions 24*b*. The clamps 22 are securely fastened to the main body upper portion 16 by rivets 26. The clamps 22** are available as part no. 225-L from Gibson Good Tools, Inc. located in Grottoes, Va.

Figure 4:
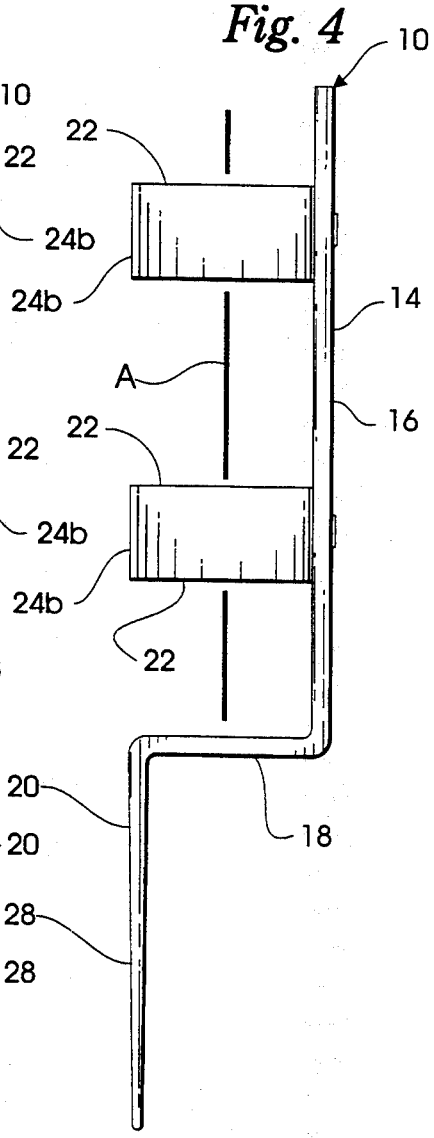
FIG. 4 is a side elevational view of the device shown in FIG. 1.

The lower portion 20 of the main body 14 includes a pair of prongs 28 that serve as a turf repair tool for repairing ball marks and impressions on putting greens. The prongs 28 are arranged side by side below the clamps 22. When the device 10 is viewed in side elevation as seen in FIG. 4, the prongs 28 are disposed in a plane that is generally parallel to longitudinal axis A of the golf club 12. This facilitates insertion of the prongs 28 into the ground.

Figure 1:
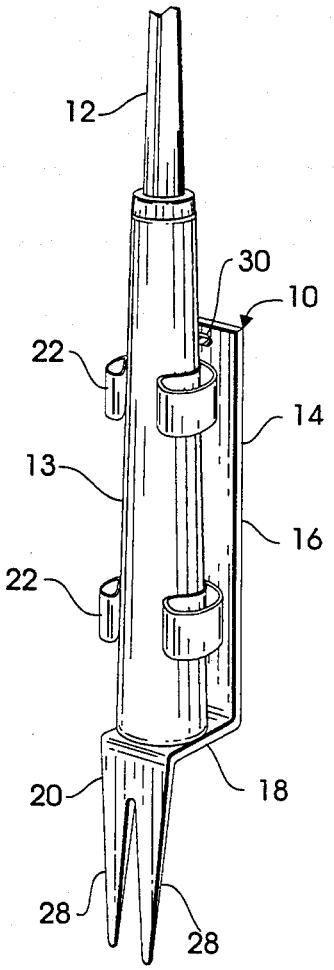
FIG. 1 is a perspective view of a device including a golf club holder and turf repair tool according to my invention taken while the device is holding a golf club.
Figure 3:
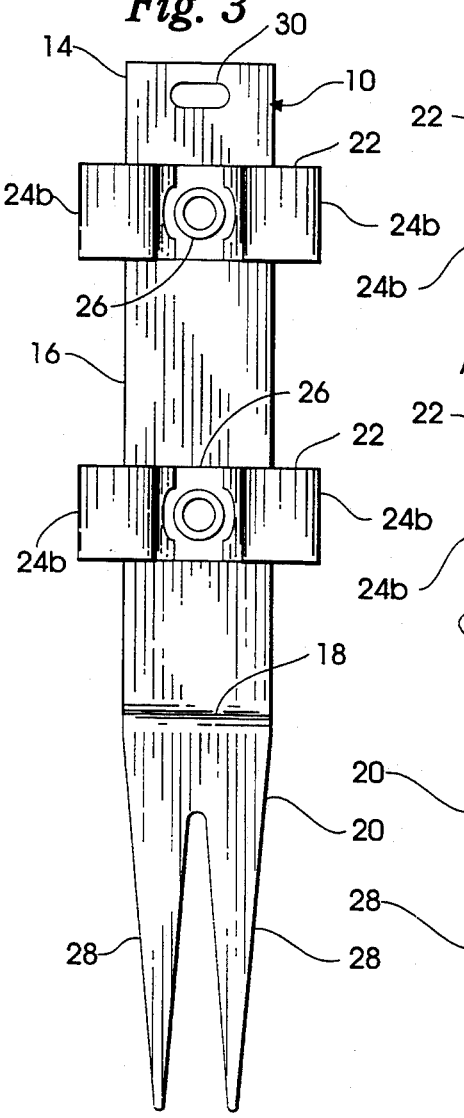
FIG. 3 is a front elevational view of the device shown in FIG. 1.

In use, a golfer would carry the device 10 with him whenever he approaches a putting green with more than one golf club such as when he takes a club for chipping and a putter. After advancing his golf ball onto the green with the chipping club, he inserts the grip 13 of that club into the clamps 22 on the device 10 as shown in FIG. 1. Next, he pushes downwardly on the head of the club so that the prongs 28 penetrate the ground. The golf club is then supported in a generally vertical orientation relative to the ground with the head elevated above the grip. In this orientation which is shown in FIG. 1, the golf club is easily noticeable and the grip remains dry.

A hole 30 formed in the upper portion 16 of the main body 14 accepts a snap hook (not shown) to permit attachment of the device 10 to a golf bag.

What is claimed is:

1. A device for holding a golf club in a generally vertical orientation relative to the ground, wherein the golf club has a head for impacting with a golf ball, an elongated shaft connected at one end to the head, and a grip attached to the other end of the elongated shaft, said device comprising:

a main body having an upper portion, an intermediate portion extending from said upper portion at substantially a right angle thereto, and a lower portion extending from said intermediate portion generally parallel to said upper portion;

clamping means attached to said main body upper portion for receiving and holding the grip on the golf club; and said main body lower portion including a pair of prongs for penetrating the ground so that the golf club is supported in said generally vertical orientation with the head elevated above the grip and for repairing ball marks and impressions on putting greens.

2. The device of claim 1, wherein said main body upper portion has a length dimension, and wherein said clamping means comprises a pair of clamps spaced apart along the length dimension of said main body upper portion.

3. The device of claim 2, wherein each of said clamps comprises a pair of resilient arms that are deflected outwardly away from each other when the golf club grip is inserted in said clamps.

4. The device of claim 3, wherein said clamps are fastened to said main body upper portion by rivets.

5. The device of claim 1, wherein said pair of prong are arranged side by side below said clamping means.

6. The device of claim 5, wherein said prongs are disposed in a plane that is generally parallel to a longitudinal axis of the golf club when the golf club grip is received and held in said clamping means.

7. The device of claim 1, wherein said main body lower portion extends from said main body intermediate portion at substantially a right angle thereto.

8. A device for holding a golf club in a generally vertical orientation relative to the ground wherein the golf club has a head for impacting with a golf ball, an elongated shaft connected at one end to the head, and a grip attached to the other end of the elongated shaft, said device comprising:

a main body having an upper portion with a length dimension, an intermediate portion extending from said upper portion at substantially a right angle thereto, and a lower portion extending from said intermediate portion at substantially a right angle thereto and arranged generally parallel to said upper portion;

a pair of clamps attached to said main body upper portion for receiving and holding the golf club grip, said clamps being spaced apart along the length dimension of said main body upper portion, each of said clamps having a pair of resilient arms that are deflected outwardly away from each other when the golf club grip is inserted in said clamps; and said main body lower portion including a pair of prongs arranged side by side below said clamps for penetrating the ground so that the golf club is supported in said generally vertical orientation with the head elevated above the grip.

* * * * *